United States Patent [19]

Theisen et al.

[11] Patent Number: 4,536,814

[45] Date of Patent: Aug. 20, 1985

[54] D. C. POWER CONTROLLER WITH FUSE PROTECTION

[75] Inventors: Peter J. Theisen, West Bend; C. Gregory Chen, Brown Deer, both of Wis.

[73] Assignee: Eaton Corporation, Cleveland, Ohio

[21] Appl. No.: 593,324

[22] Filed: Mar. 26, 1984

[51] Int. Cl.[3] ..... H01H 33/14

[52] U.S. Cl. ..... 361/7; 361/12; 361/104

[58] Field of Search ..... 361/5–8, 361/12–14, 104

[56] References Cited

U.S. PATENT DOCUMENTS

| | | | |
|---|---|---|---|
| 3,761,734 | 9/1973 | Windecker | 361/104 |
| 4,025,820 | 5/1977 | Penrod | 361/8 |
| 4,322,771 | 3/1982 | Struger | 361/104 |
| 4,420,784 | 12/1983 | Chen et al. | 361/7 |

*Primary Examiner*—Harry E. Moose, Jr.
*Attorney, Agent, or Firm*—C. H. Grace; Wm. A. Autio

[57] ABSTRACT

A D.C. power controller for interrupting a high voltage high current D.C. power line supplying a load (L) from a D.C. power supply source (+270VDC) having power contacts (CCC, AC), actuator means (MA, SA) for operating the power contacts (CCC, AC), arc extinguishing means (AH1, AH2, AS1, AS2), arc shunting solid state elements (SSC) for receiving the arc current from the power contacts, electronic control means (CE) for controlling the actuator means, protective means comprising a fuse (F) and fuse shunt contacts (FSC) in parallel in the power line, and the electronic control means (CE) controlling the actuator means (MA, SA) to close first and open last the fuse shunt contacts with respect to the power contacts so that the fuse will blow to interrupt the power line in the event either the power contacts or the solid state elements fail to do so, and the electronic control means being supplied with power through the fuse to disable the same when the fuse blows so that the load cannot be reenergized before the fault is corrected.

5 Claims, 2 Drawing Figures

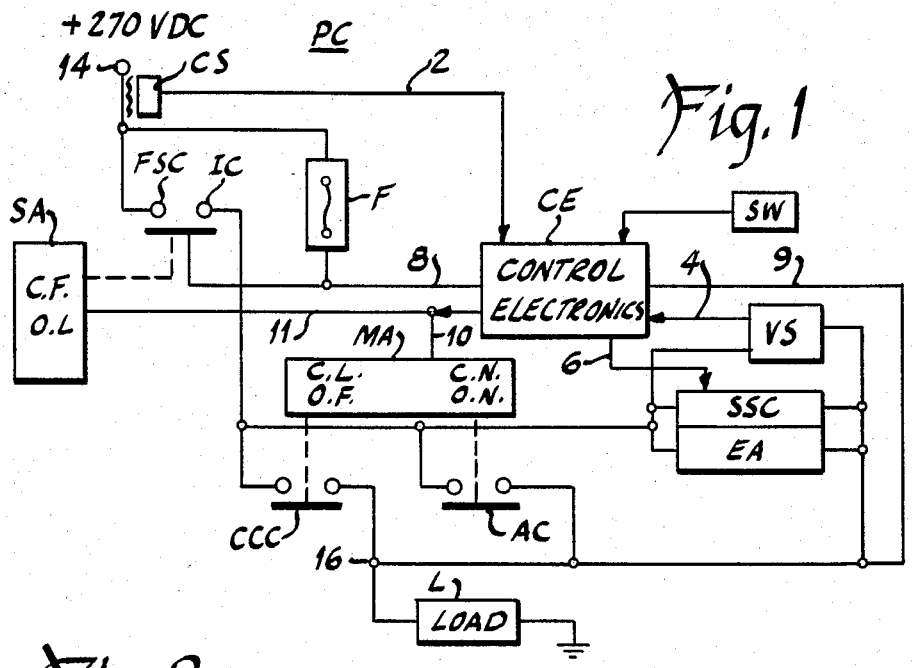
Fig. 1
Fig. 2
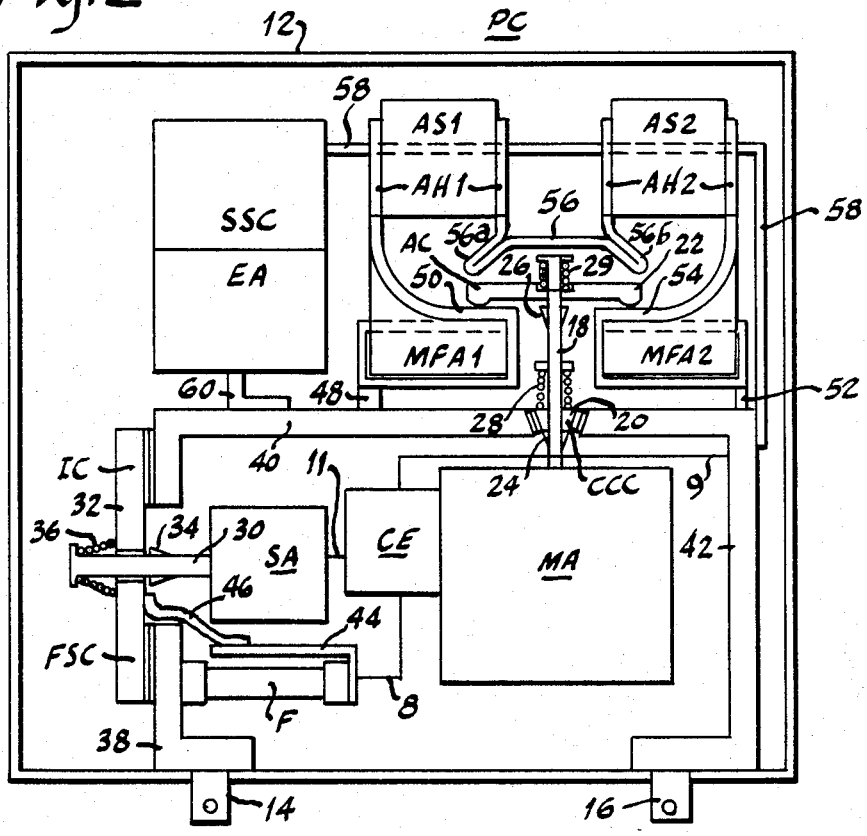

D. C. POWER CONTROLLER WITH FUSE PROTECTION

BACKGROUND OF THE INVENTION

Contactor devices including arc suppression means and fuse protection have been known heretofore. For example, J. K. Penrod Pat. No. 4,025,820, dated May 24, 1977, shows an electrical contactor device having a solid state arc suppression circuit connected either directly in parallel with the main relay contacts or connected in series with a protection circuit across the main relay contacts. The main relay has not only main contacts for closing the load circuit but first auxiliary contacts for gating the arc suppression circuit and second auxiliary contacts for operating an auxiliary relay which operates the protection circuit. A first alternating current power supply supplies the load and a second alternating current power source supplies the relays. The protection circuit includes a fuse that blows in the event the solid state devices in the arc suppression circuit become short circuited and opens a contact to disconnect the second alternating current power source from the relays thereby to prevent operation of the contactor device. This prior art contactor device has certain disadvantages in that it not only is rather complex in structure but also it provides no protection in case the power circuit to the load should fail. Accordingly, it has been found desirable to provide a D.C. power controller with improved fuse protection.

SUMMARY OF THE INVENTION

An object of the invention is to provide an improved D.C. power controller with fuse protection.

A more specific object of the invention is to provide a D.C. power controller with improved fuse protection such that in the event of a malfunction the fuse directly disables the power controller rather than through a switch or the like.

Another specific object of the invention is to provide an improved D.C. power controller with fuse protection such that the fuse is in the power circuit and not only disconnects the power to the load but also disconnects the power to the control circuit which receives its power from the same source.

Another specific object of the invention is to provide a D.C. power controller with arc suppression means and fuse protection arranged so that the fuse provides protection regardless of whether the arc suppression means fails shorted or open and the power controller contacts arc.

Another specific object of the invention is to provide a power controller having power contacts, arc suppression means and isolation contacts with improved fuse protection means that will protect the circuit in the event the power contacts or the arc suppression means fail to open the circuit and even if the isolation contacts open in a normal manner.

Other objects and advantages of the invention will hereinafter appear.

BRIEF DESCRIPTION OF THE DRAWINGS

FIG. 1 is a block diagram of a D.C. power controller with fuse protection constructed in accordance with the invention and showing application of the invention to a power line supplying a load from a high voltage D.C. source.

FIG. 2 is a top view, with the cover removed, of an electromechanical power relay used in the D.C. power controller of FIG. 1 to show the contacts, their operating mechanisms and related elements enclosed within the relay enclosure.

DESCRIPTION OF THE PREFERRED EMBODIMENT

Referring to FIG. 1, there is shown in block diagram a D.C. power controller PC with fuse protection constructed in accordance with the invention. As shown therein, a high voltage source such as a 270 volt D.C. source is connected in series through fuse shunt contacts FSC, isolation contacts IC and current carrying contacts CCC and a load L to ground so that when these contacts are closed the load is energized. Arcing contacts AC are connected across or in parallel with current carrying contacts CCC. Current carrying contacts CCC and arcing contacts AC are of the double break type as shown in FIG. 1. A double break contact may also be used for fuse shunt contacts FSC and isolating contacts IC as shown in FIG. 1 but there is no requirement that these two contacts should close simultaneously or open simultaneously as will become apparent as the description proceeds. Current carrying contacts CCC and arcing contacts AC are controlled by a contact operating mechanism or main actuator MA as indicated by the broken lines, this main actuator MA being of the electromagnetic type or the like hereinafter more fully described in connection with FIG. 2. Fuse shunt contacts FSC and isolating contacts IC or second actuator SA as indicated by the broken line in FIG. 1. Main actuator MA and second actuator SA are controlled by a manual switch SW or the like through control electronics CE such that fuse shunt contacts FSC and isolating contacts IC will close first (C.F.), arcing contacts AC will close next (C.N.) to complete the circuit and current carrying contacts CCC will close last (C.L.). On opening, current carrying contacts CCC will open first (O.F.), arcing contacts AC will open next (O.N.) to interrupt the circuit and fuse shunt contacts FSC and isolating contacts IC will open last (O.L.). Thus, arcing contacts AC will not only close the circuit but will also interrupt the circuit to the load since these contacts are constructed to withstand arcs in the usual manner.

To aid in extinguishing the arc on arcing contacts AC when these contacts are opened, there is provided a current shunting circuit connected across contacts AC that comprises solid state components SSC and energy absorber means EA that are illustrated and described in more detail in C. G. Chen et al U.S. Pat. No. 4,420,784, dated Dec. 13, 1983, which is incorporated herein by reference.

In order to determine when the solid state components SSC should be turned on, the current in the power line and the voltage across arcing contacts AC are sensed. For this purpose, there is provided a current sensing device CS adjacent the 270 volt D.C. line which current sensing device may be similar to that described in the aforementioned C. G. Chen patent. This current sensor CS is connected through line 2 to control electronics CE. A voltage sensing circuit VS is connected across arcing contacts AC to sense the voltage across the contacts and is connected through line 4 to control electronics CE. Control electronics CE acts through line 6 to gate the solid state components SSC on and off at the appropriate times as described in the aforementioned C. G. Chen patent.

A fuse F is connected across or in parallel with fuse shunt contacts FSC as shown in FIG. 1. The load current normally contacts IC and then in parallel through current carrying contacts CCC and arcing contacts AC. However, whenever fuse shunt contacts FSC are opened any load current flowing in this circuit will be diverted to fuse F for purposes hereinafter described. Operating power is supplied from the 270 volt D.C. source through fuse F and fuse shunt contacts FSC in parallel and line 8 to control electronics CE and then through line 9 to ground so as to disable the control electronics whenever the fuse blows with contacts FSC open and thus prevent reclosure of the load circuit.

The system shown in FIG. 1 operates generally as follows. When switch SW is actuated, it acts on control electronics CE which applies a signal through lines 10 and 11 to main actuator MA and second actuator SA to close fuse shunt contacts FSC and isolating contacts IC first, to close arcing contacts AC next and to close current carrying contacts CCC last. With fuse shunt contacts FSC and isolating contacts IC closing first, no arcing will occur at these contacts. Arcing contacts AC will close next to complete the 270 volt D.C. circuit to the load and these contacts will handle any arc occurring at closure of the power circuit. Current carrying contacts CCC will close last after the load circuit has been completed by the arcing contacts and thereafter will serve to carry the load current. When switch SW is actuated to cause opening of the load circuit, current carrying contacts CCC will open first whereafter arcing contacts AC will open next to interrupt the load circuit and after solid state components SSC and energy absorber means EA have extinguished any arcs occurring at the arcing contacts, isolating contacts IC and fuse shunt contacts FSC will open. When arcing contacts AC open and draw an arc, current sensor CS senses the current in the line and voltage sensor VS senses the voltage across the arcing contacts AC and, when the current and voltage have reached a predetermined ratio, control electronics CE gates the solid state components SSC to turn them on thereby to shunt any arcing current from the arcing contacts AC as described in the aforementioned C. G. Chen et al patent. After a predetermined time, solid state components SSC are turned off by control electronics CE and any remaining energy across arcing contacts AC is absorbed by energy absorber means EA, thereupon interrupting completely the power circuit to load L. Thereafter, isolating contacts IC open to completely isolate the load from the power supply and to insure that there will be no leakage of current through the solid state components SSC.

Fuse F and fuse shunt contacts FSC are provided as a protective means for controlling interruption of the power line to the load in the event either the power contacts such as arcing contacts AC and current carrying contacts CCC or solid state components SSc fail to do so. In such event, it will be apparent that fuse F directly interrupts the load circuit and the power to the control electronics, not through the intermediary of other components. For this purpose, let it be assumed that the load circuit is to be interrupted and switch SW is actuated. The control electronics CE controls main actuator MA to open current carrying contacts CCC first followed by opening of arcing contacts AC. The current and voltage are then sensed and solid state components SSC are gated to transfer any remaining arc from arcing contacts AC thereto whereafter solid state components SSC are turned off and any remaining arcing current is absorbed by energy absorber means EA. Immediately thereafter second actuator SA is operated to open isolating contacts IC and fuse shunt contacts FSC. Now, let it be assumed that load current continued to flow after fuse shunt contacts FSC opened. In such case, fuse F immediately blows to interrupt the load circuit. In such case, fuse F also interrupts the power from the 270 volt D.C. supply to control electronics CE to disable the latter and thus prevent reclosure of the load circuit before the fault which caused the undesired load current flow is corrected. Under these conditions, it will be apparent that it does not make any difference whether fuse shunt contacts FSC and isolating contacts IC open simultaneously or not. These isolating contacts IC and fuse shunt contacts FSC have very short arc gaps so as not to be able to interrupt the load circuit if either the arcing contacts or the solid state components fail to do so. Therefore, the fuse will blow whether isolation contacts IC open together with the fuse shunt contacts FSC or before. In either case, when fuse shunt contacts FSC open, the fuse will blow if there is any load current flowing as a result of a fault. The short arc gap of the fuse shunt contacts FSC is enough to transfer the current to the fuse and thereupon cause it to blow. From the foregoing it will be apparent that the fuse will protect the circuit regardless of whether the solid state components fail shorted or open. If the solid state components fail shorted, enough load current will of course flow to cause the fuse F to blow. If the solid state components fail open, arcing contacts AC will then continue to arc long enough to cause fuse F to blow when fuse shunt contacts FSC are opened.

The contacts and their operating mechanisms and related elements shown schematically in FIG. 1 are shown in more detail in FIG. 2. As shown in FIG. 2, this power controller or relay is provided with an insulating housing 12 of generally rectangular or square configuration having space therein for the various parts shown in FIG. 1. Switch SW, if it is a manual switch, will be mounted on the relay housing or at a remote location where it is accessable for manual actuation.

As shown in FIG. 2, power controller PC is provided with a pair of terminals 14 and 16 whereby it may be connected to a power supply and also through a load to ground. These terminals 14 and 16 are also shown in FIG. 1 wherein terminal 14 is shown as the connection to the 270 volt D.C. source and terminal 16 is shown as connected through the load L to ground. Main actuator MA in FIG. 2 which may be an electromagnet is provided with an operating member 18 which carries both the bridging contact 20 for current carrying contacts CCC and the bridging contact 22 for arcing contacts AC. Lugs 24 which actuate bridging contact 20 and lugs 26 which actuate bridging contact 22 are spaced and arranged on operating member 18 with respect to the bridging contacts bias springs 28 and 29, respectively, such that when main actuator MA is energized to extend operating member 18, bridging contact 20 opens first followed by opening of bridging contact 22, this main actuator MA being controlled by control electronics CE. Second actuator SA which may also be an electromagnet or the like is controlled by control electronics CE such that when it is energized, it will extend its operating member 30 to open bridging contact 32. Operating member 30 has lugs 34 that bear against bridging contact 32 to open this contact and a bias spring 36 that normally holds the bridging contact against the lugs.

As shown in FIG. 2, a circuit may be traced from terminal 14 through a connector and stationary contact 38, bridging contact 32, another stationary contact and connector 40, bridging contact 20 and another stationary contact and connector 42 to terminal 16. Fuse F is connected at one end to connector 38 and at its other end through connector 44 and a wire 46 such as a "pigtail" to bridging contact 32.

Arcing contacts AC are connected in parallel with current carrying contacts CCC in FIG. 2. For this purpose, a conductive strip 48 is connected to connector 40 and is wrapped counterclockwise one or more times around the yoke portion of a U-shaped magnetic field amplifier MFA1 to provide the left stationary contact 50 of arcing contacts AC and then continues in a leftward and upward curvature to provide the left side of a first arc horn AH1. A second conductive strip 52 is connected to connector 42 and is wound in a counterclockwise direction around the yoke portion of a U-shaped magnetic field amplifier MFA2 to provide a second stationary contact 54 for arcing contacts AC. Conductive strip 52 then continues from stationary contact 54 in a rightward and upward curvature to provide the right side of a second arc horn AH2. A conductive member 56 generally in the shape of a U with its two lower corners having bent back pinched portions **56*a* and 56*b* that extend into the vicinity of the opposite ends of bridging contact 22 forms the inner left and right sides of arc horns AH1 and AH2, respectively. As will be apparent, when arcing contacts AC open, the arcs will move from the ends of bridging contact 22 to the arc horn and will move up the arc horn under the magnetic forces of magnetic field amplifiers MFA1 and MFA2. A pair of arc splitters AS1 and AS2 are positioned between the upper end portions of the two sides of arc horns AH1 and AH2 beyond magnetic field amplifiers MFA1 and MFA2 to receive the arcs and split and extinguish the same. While magnetic field amplifiers MFA1 and MFA2 have almost two turns of conductive strips 48 and 52 wrapped around the yoke portions thereof, respectively, it will be apparent that three-fourths of a turn such as shown in the aforementioned C. G. Chen et al patent may be used or, on the other hand, more than the turns shown in FIG. 2** may be used. For a more detailed description of this arc blowout and splitting structure, reference may be had to the aforementioned C. G. Chen et al patent.

Solid state Components SSC and energy absorber means EA are connected in parallel with one another across arcing contacts AC by pairs of conductors 58 and 60, conductors 58 connecting to connector 42 and conductor 60 connecting to connector 40 as shown in FIG. 2. Control electronics CE receives operating power through conductors 8 and 9 connected to fuse F and terminal 16, respectively.

All of the contacts are shown closed in FIG. 2. To open the contacts, control electronics CE controls main actuator MA to cause it to extend its operating member 18 upwardly, causing lugs 24 thereon to open current carrying contacts CCC first and then causing lugs 26 to open arcing contacts AC. Thereafter, control electronics CE applies to control through conductor 11 to second actuator SA to cause it to extend its operating member 30 to open isolating contacts IC and fuse shunt contacts FSC. When arcing contacts AC are opened as hereinbefore described, the arcs at the opposite sides thereof will move into arc horns AH1 and AH2 and be propelled upwardly therealong by magnetic field amplifiers MFA1 and MFA2 into arc splitters AS1 and AS2 to be split up and extinguished therein. Also, at the same time, solid state components SSC will be gated to have any remaining arc currents transferred thereto and extinguished when these solid state components are turned off by control electronics CE and any remaining energy absorbed in energy abosrber EA as hereinbefore described.

While the apparatus hereinbefore described is effectively adapted to fulfill the objects stated, it is to be understood that the invention is not intended to be confined to the particular preferred embodiment of D.C. power controller with fuse protection disclosed, inasmuch as it is susceptible of various modifications without departing from the scope of the appended claims.

We claim:

1. A D.C. power controller for effectively interrupting a high voltage high current D.C. power line supplying a load from a D.C. power supply source comprising:

power contacts in said power line;

actuator means for closing and opening said power contacts;

arc extinguishing means associated with said power contacts;

means for initiating "close" and "open" commands;

arc-shunting solid state elements in parallel with said power contacts and controllable to receive the arching current from said power contacts and to interrupt the same;

and control means comprising:

electronic control means responsive to said close and open commands and to voltage and current levels in the power line for controlling said actuator means and said solid state elements to interrupt said power line;

protective means for controlling interruption of said power line in the event either said power contacts or said solid state elements fail to do so comprising:

a fuse and fuse shunt contacts in parallel in said power line;

said actuator means comprising means for closing and opening said fuse shunt contacts;

said electronic control means also comprising means for controlling said actuator means to close first and open last said fuse shunt contacts with respect to said power contacts such that said fuse will blow to interrupt the power line in the event either said power contacts or said solid state elements fail to do so;

and means supplying operating power to said electronic control means from said D.C. power supply through said fuse so that in the event said fuse blows said electronic control means becomes inoperative and cannot be used to reclose said power contacts to be left unprotected.

2. The D.C. power controller claimed in claim 1, wherein:

said power contacts comprise arcing contacts and current carrying contacts connected in parallel in said power line;

and said actuator means comprises means for closing last and opening first said current carrying contacts with respect to said arcing contacts whereby said fuse shunt contacts close first and said arcing contacts close next to close the power line and said current carrying contacts close last and on reopening said current carrying contacts open first and said arcing contacts open next to open the power line and said fuse shunt contacts open last.

3. The D.C. power controller claimed in claim 1, wherein:

said power controller also comprises isolating contacts connected in said power line between said fuse shunt contacts and said power contacts;

and said actuator means comprises means for normally closing and opening said isolation contacts simultaneously with said fuse shunt contacts so as to interrupt when open any leakage current that might otherwise flow through said solid state elements.

4. The D.C. power controller claimed in claim 3, wherein:

said isolation contacts have a short arc gap when open so as not to be able to interrupt the power line in the event said power contacts or said solid state elements fail to do so whereby said fuse will blow regardless of whether said isolation contacts open simultaneously with said fuse shunt contacts or before.

5. The D.C. power controller claimed in claim 4, wherein:

said fuse shunt contacts have an arc gap sufficient when open to transfer the current to said fuse to cause said fuse to blow when said power contacts or said solid state elements fail to interrupt the power line.

* * * * *